United States Patent [19]

Teppo et al.

[11] Patent Number: 4,951,995

[45] Date of Patent: Aug. 28, 1990

[54] ARM HEIGHT ADJUSTMENT MECHANISM FOR A CHAIR

[75] Inventors: David S. Teppo, Wyoming; Thomas R. Demmon, Grand Rapids; Larry DeKraker, Holland; James P. Steffens, Hopkins, all of Mich.

[73] Assignee: Steelcase Inc., Mich.

[21] Appl. No.: 418,847

[22] Filed: Oct. 10, 1989

[51] Int. Cl.[5] ..... A47C 7/54

[52] U.S. Cl. ..... 297/411; 74/500.5; 74/501.5 R; 74/502

[58] Field of Search ..... 297/411, 412, 417, 115

[56] References Cited

U.S. PATENT DOCUMENTS

| | | | |
|---|---|---|---|
| 1,977,702 | 10/1934 | Summerlee et al. | 297/411 |
| 4,176,878 | 12/1979 | Koutsky | 297/415 |
| 4,239,282 | 12/1980 | White | 297/411 X |
| 4,277,102 | 7/1981 | Aaras et al. | 297/411 |
| 4,489,980 | 12/1984 | Friedrich | 297/417 |
| 4,657,305 | 4/1987 | Meiller | 297/417 |
| 4,884,846 | 12/1989 | Tobler | 297/411 |

*Primary Examiner*—Peter A. Aschenbrenner

*Attorney, Agent, or Firm*—Price, Heneveld, Cooper, De Witt & Litton

[57] ABSTRACT

An arm height adjustment mechanism for a chair of the type having a pair of laterally spaced, fixed armrest supports. The mechanism includes first and second armrests slidably mounted on said supports for vertical movements. A vertical motion translation mechanism interconnects said armrests so that vertical movement of one armrest translates to synchronized, simultaneous vertical movement of the other armrest.

23 Claims, 3 Drawing Sheets

ARM HEIGHT ADJUSTMENT MECHANISM FOR A CHAIR

BACKGROUND OF THE INVENTION

The present invention relates to a chair and more particularly to a unique mechanism for causing synchronized, vertical height adjustment of the chair armrests.

A wide variety of chairs are presently available for use in the office environment. Such chairs typically include multiple adjustment features in order to adapt the chairs to the particular task and the particular user. The chairs may include vertical seat height adjustment, back height adjustment and the like. Such office chairs may also include spaced armrests. Heretofore, the vertical positioning of the armrests with respect to the seat, has been fixed. A need exists for a chair and armrest height adjustment mechanism which permits synchronized, simultaneous adjustment of the armrests with respect to their supports and the chair seat.

SUMMARY OF THE INVENTION

In accordance with the present invention, the aforementioned need is fulfilled. Essentially, an armrest height adjustment assembly is provided which includes a pair of slidably mounted and vertically movable armrests. Provision is made for interconnecting the armrests so that vertical movement of one armrest translates into simultaneous, synchronized vertical movement of the other armrest.

In narrower aspects of the invention, the armrests telescope on fixed supports. A cable assembly, extending between the supports, includes a housing having ends fixed to the supports and a flexible cable. The flexible cable has one end fixed to one of the armrests and a free end extending from the opposite end of the housing. The other armrest includes an elongated member fixed thereto for movement therewith. The cable free end and the fixed member are each formed with a spiral flight. A rotatable gear fixed to one of the supports translates movement of the cable free end in one direction to movement in the opposite direction of the elongated member. In addition, provision is made for locking the gear so that the armrests remain in their selected position.

DETAILED DESCRIPTION OF THE PREFERRED EMBODIMENT

Figure 1:
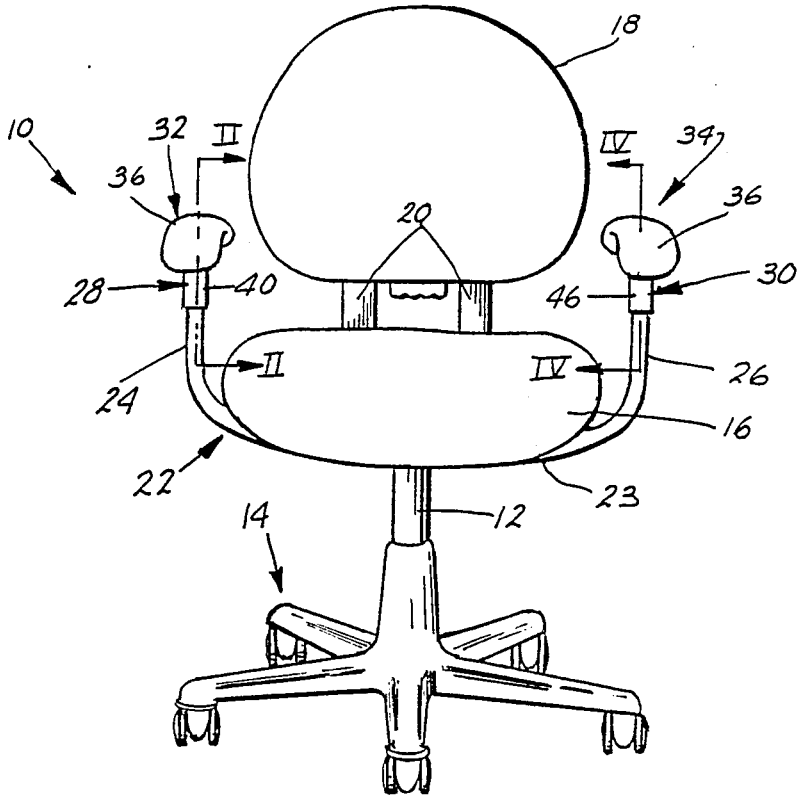
FIG. 1 is a front, elevational view of a chair incorporating height adjustment mechanism in accordance with the present invention.
Figure 2:
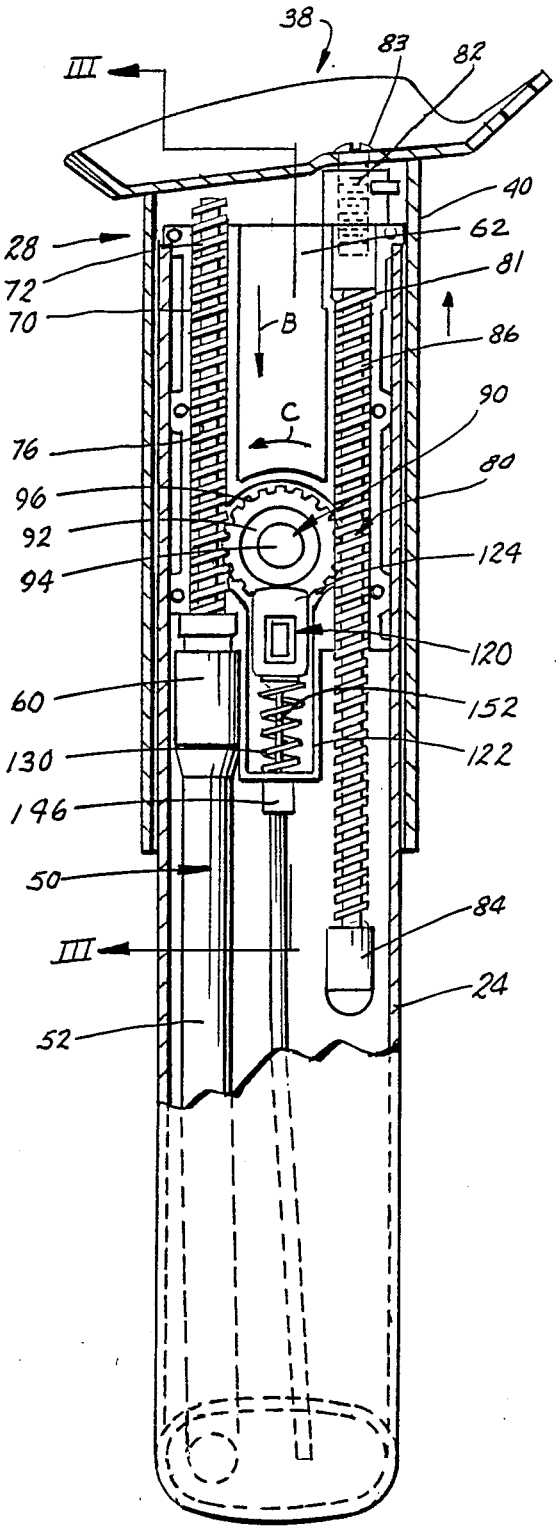
FIG. 2 is a cross sectional view taken generally along line II—II of FIG. 1.
Figure 5:
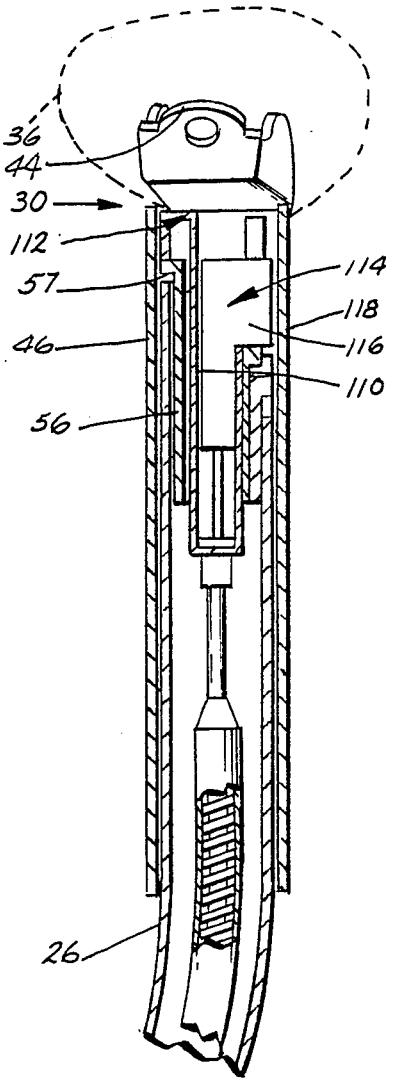
FIG. 5 is a cross sectional view taken generally along line V—V of FIG. 4.
Figure 4:
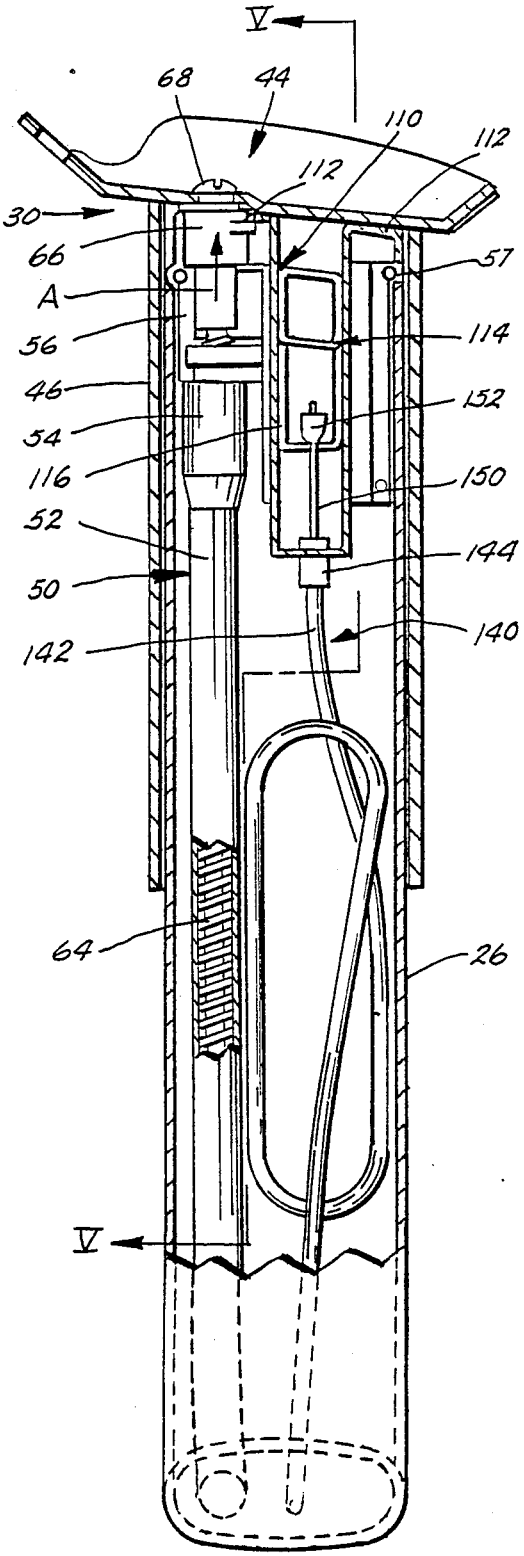
FIG. 4 is a cross sectional view taken generally along line IV—IV of FIG. 1.

A chair including an armrest height adjustment mechanism in accordance with the present invention is illustrated in FIG. 1 and generally designated by the numeral 10. Chair 10 includes a support pedestal 12 mounted on a castered base 14. A chair seat 16 is supported on pedestal 12 by a suitable chair control (not shown). A chair back 18 is mounted on pedestal 12 by uprights 20. A generally U-shaped, tubular armrest support 22 is mounted on chair 10. Support 22 includes a base 23 and vertical upright portions 24, 26 having ends 28, 30. Base 23 joins the uprights. A first armrest assembly 32 is mounted on upright 24. A second armrest assembly 34 is mounted on upright 26. Armrest 32 includes an armrest member 36 (FIG. 1). Member 36 is secured to an armrest bracket 38 (FIG. 2). Armrest bracket 38 is secured to an outer telescoping tube 40 which is slidably mounted for vertical movement on tubular upright 24. Similarly, armrest assembly 34 includes an armrest member 36 (FIG. 1) which is mounted on a bracket 44 (FIGS. 4 and 5). Bracket 44 is secured to another telescoping tube 46 which is slidably mounted on armrest support upright 26. As a result, armrests 32, 34 may be positioned vertically with respect to supports 24, 26 and hence seat 16.

Figure 3:
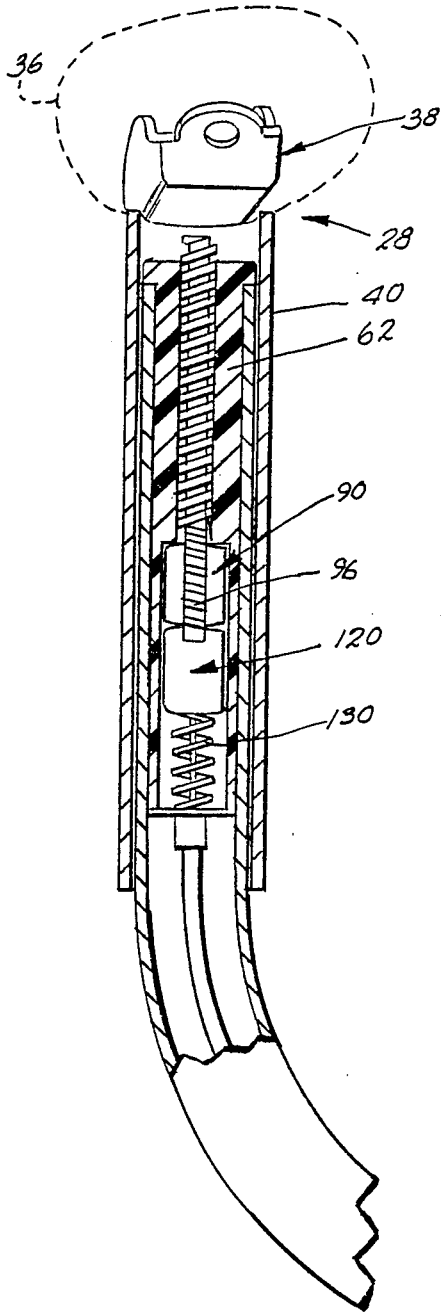
FIG. 3 is a cross sectional view taken generally along line III—III of FIG. 2.

In accordance with the present invention, provision is made for translating vertical movement of bracket 44 of armrest assembly 34 into synchronized, simultaneous vertical movement of armrest assembly 32. As seen in FIGS. 2-5, a cable assembly 50 includes an outer housing or jacket 52. Housing 52 includes a first end 54 which is fixed to upright 26 by an end cable and lock housing or plug 56 firmly disposed and retained within the open end of upright 26. End cable and lock housing 56 includes a peripheral flange 57 which abuts upper end of open tubular upright 26. As seen in FIG. 5, housing 56 is firmly pressed into upright 26 and engages an inner surface thereof. Jacket 52 is flexible and extends through the armrest support 22 underneath seat 16. An opposite end or plug 60 of jacket 52 abuts and is fixed to a cable and gear housing or plug 62 which is firmly disposed and retained within open end of upright 24 (FIGS. 2 and 3). Plug 62 includes a flange 63 which abuts and is pressed against the upper end of open tubular upright 24. The sides of plug 62 engage the inner surface of the upright. Extending through jacket 52 is a flexible, elongated cable 64. Cable 64 includes an end fitting 66 which is secured to bracket 44 by a fastener 68 (FIG. 4). Cable 64 extends through the jacket and into a groove or slot 70 defined by plug 62. Cable 64 terminates in a free end 72. Vertical motion of bracket 44 causes opposite vertical motion of free end 72 of cable 64. For example, upward movement of bracket 44 results in downward movement of cable end 72. As shown, cable 64 is formed with an elongated, spiral flight or rack portion 76.

As seen in FIG. 2, an elongated rack, rod or cable length 80 is slidably mounted on housing 62. Rod or cable length 80 includes an end fitting 82 fixed to bracket 38 by a fastener 83. Cable 80 extends downwardly within a passage or slot 81 defined by housing or plug 62 and terminates in a free end 84. Cable or rack 80 is similarly formed with a spiral flight or rack portion 86. Vertical movement of cable 86 results in vertical movement of bracket 38 of armrest assembly 36.

Free end 72 of cable 64 is interconnected with cable 80 by a gear 90. Gear 90 has a hub 92 rotatably mounted on a stub shaft 94 secured to or defined by plug 62. Gear 90 defines teeth 96 which mesh with spiral flight 76 on cable 64 and with spiral flight 86 on elongated rod or cable 80. The flights and gear function as a rack and pinion means.

As should now be apparent, upward movement of armrest bracket 44 pulls cable end 66 upwardly and cable end 72 is pulled downwardly as designated by arrows "A" and "B" in FIGS. 4 and 2, respectively. Gear 90 will rotate in a counterclockwise direction since it intermeshes with spiral 76 (Arrow C in FIG. 2). Gear 90, therefore, since it meshes with cable or rod spiral flight 86 translates downward movement of cable end 72 into upward movement of elongated rod or member 80. As a result, armrest bracket 38 will move upwardly in synchronization with upward movement of bracket 44. Also, downward movement of bracket 44 causes rotation of gear 90 in a clockwise direction causing downward movement of armrest bracket 38. The mechanism translates upward movement of one armrest assembly into upward movement of the other assembly. The device operates using only one hand.

A lock mechanism is provided to lock the armrest assemblies in their adjusted positions. As seen in FIGS. 2–5, the lock mechanism includes a lock housing 110. Housing 110 includes an upper portion 112 engaging the underside of bracket 44. Housing 110 is held against bracket 44 by a flange 112 or cable end fitting 66. Housing 110 moves with bracket 44 and tube 46. Slidably disposed within housing 110 is a slide 114. Slide 114 includes an actuator portion 116 which extends through a slot 118 formed in upright 26 and in the outer telescoping tube 46. A knob may be inserted into open end of portion 116. A user can, therefore, lift up slide 114 with respect to housing 110. As shown in FIG. 2, a locking pawl 120 is slidably mounted within a portion 122 of plug or housing 62. Pawl 120 is slotted and defines teeth 124 which mesh with the teeth of gear 90. Pawl 120 is biased into locking engagement with gear 90 by a spring 130. Slide or actuator 114 is connected to pawl 120 by a cable assembly 140. Cable assembly 140 includes an outer jacket 142 having an end 144 fixed to lock housing 110. An opposite end 146 of the jacket is fixed to portion 122 of plug 62. A cable 150 has an end fitting 152 which secures the cable to slide 114. An opposite end 152 of the cable is fixed to locking pawl 120. As a result, upward movement of slider 140 causes the pawl 120 to be pulled downwardly by cable 150 against the resilient bias of spring 130. When in such downward or inoperative position, gear 90 is released. Armrest bracket 44 may then be moved upwardly or downwardly in a single handed fashion causing simultaneous, synchronized movement of armrest 38.

The height adjustment mechanism in accordance with the present invention provides reliable, synchronized movement of the armrest assemblies. The elements of the assembly are relatively easily manufactured and assembled. The operative portions are hidden within the tubular armrest support. In view of the above description, those of ordinary skill in the art may envision various modifications to the present invention which would not depart from the inventive concepts disclosed. For example, the lock mechanism could be mounted within upright 24. A spring biased pin or plunger could be substituted for the pawl shown. Also, other direction translation mechanisms besides the cable/gear/cable arrangement shown might be used. Also, the flights could be replaced by a toothed rack engaged by the gear. It is expressly intended, therefore, that the above should be considered as only that of the preferred embodiment. The true spirit and scope of the present invention may be determined by reference to the amended claims.

The embodiment of the invention in which an exclusive property or privilege is claimed are defined as follows:

1. An armrest height adjustment assembly for a chair having a pair of laterally spaced, fixed armrest supports, said assembly comprising:
   - a first armrest slidably mounted on one of said supports for vertical movement;
   - a second armrest slidably mounted on the other of said supports for vertical movement; and
   - vertical motion translation means interconnecting said armrests for translating raising or lowering movement of said first armrest to said second armrest so that vertical movement of said first armrest causes synchronized, simultaneous vertical movement of said second armrest.

2. An assembly as defined by claim 1 further including lock means for releasably locking said armrests in position with respect to said armrest supports.

3. An assembly as defined by claim 1 wherein said vertical motion translating means comprises:
   - an elongated cable assembly including a jacket having an end fixed to said one of said supports and a cable end fixed to said first armrest, said cable assembly jacket including a second end fixed to said other of said supports and another cable end that is free and that moves downwardly upon upward movement of said first armrest and said a cable end;
   - an elongated member having an end fixed to said second armrest; and
   - means interconnecting said another cable end and said elongated member for moving said elongated member upwardly upon downward movement of said another cable end.

4. An assembly as defined by claim 3 wherein said cable includes a spiral flight and said elongated member includes a spiral flight.

5. An assembly as defined by claim 4 wherein said means interconnecting said another cable end and said elongated member comprises a gear rotatably mounted on said other of said supports, said gear meshing with said cable flights of said cable and said elongated member to translate downward movement of said another cable end to upward movement of said elongated member.

6. An assembly as defined by claim 5 further including lock means for releasably locking said armrests in position with respect to said armrest supports.

7. An assembly as defined by claim 6 wherein said lock means comprises:
   - a lock defining teeth engageable with said gear to prevent rotation thereof; and
   - an actuator connected to said lock for moving said lock out of engagement with said gear.

8. A vertical arm height adjustment mechanism for a chair which has a pair of laterally spaced armrest supports, said mechanism comprising:
   - a first armrest assembly mounted for vertical movement on one of said supports;
   - a second armrest assembly mounted for vertical movement on the other of said supports;
   - a first elongated member having an end fixed to said first armrest assembly for up and down movement therewith;
   - a second elongated member secured to said second armrest for moving said second armrest assembly up and down;

motion translating means interconnecting said first elongated member and said second elongated member for moving said second member in an upward direction upon upward movement of said first armrest whereby vertical movement of said first armrest translates to synchronized vertical movement of said second armrest.

9. A mechanism as defined by claim 8 wherein said armrest supports are joined to defined a generally U-shaped, tubular support.

10. A mechanism as defined by claim 8 wherein each of said armrest assemblies includes a tube telescoping with a respective one of said armrest supports.

11. A mechanism as defined by claim 8 wherein said first elongated member comprises a cable assembly having a jacket with an end fixed to said one of said supports and another end fixed to said other of said supports, said cable assembly further including an elongated flexible cable having a cable end fixed to said first armrest assembly and an opposite cable end extending upwardly within said other of said supports.

12. A mechanism as defined in claim 11 wherein said flexible cable opposite cable end defines a rack portion and said elongated member defines another rack portion.

13. A mechanism as defined in claim 12 wherein said motion translating means comprises a gear mounted on said other of said supports, said gear including teeth meshing with said rack portions.

14. A mechanism as defined by claim 13 when each of said armrest assemblies includes a tube telescoping with a respective one of said armrest supports.

15. A mechanism as defined by claim 8 further including lock means engaging said motion translating means for locking said armrest assemblies is position and preventing vertical movement thereof.

16. A mechanism as defined by claim 14 further including lock means operatively connected to said armrest assemblies for preventing movement thereof.

17. A mechanism as defined by claim 16 wherein said lock means comprising:

a locking pawl engageable with said gear, and an actuator connected to said pawl for moving said pawl into and out of engagement with said gear.

18. A chair of the type including a base, a seat mounted on the base and a back, said chair further comprising:

a generally U-shaped tubular armrest support including a pair of open ended support uprights joined to an elongated base, said base extending under said seat;

a pair of armrest assemblies, each assembly having a tubular portion telescoped on one of said support uprights;

vertical motion translating means within said armrest support and operatively interconnecting said armrest assemblies for translating vertical movement of one of said assemblies to vertical movement of the other of said assemblies.

19. A chair as defined by claim 18 wherein said vertical motion translating means comprises:

a first plug disposed within one of said uprights;

a second plug disposed within the other of said uprights;

a cable assembly having a jacket abutting said plugs and an elongated cable having a first end extending through said second plug and joined to one of said armrest assemblies, said cable including a second free end extending through said first plug;

another cable having an end fixed to said other of said armrest assemblies and extending through said first plug; and means interconnecting said second free end of said cable of said cable assembly and said another cable so that movement of said free end is translated to opposite movement of said another cable.

20. A chair as defined by claim 19 wherein said interconnecting means comprising said free end and said another cable each defining a rack-like portion and a gear mounted on said first plug and meshing with said rack-like portions.

21. A chair as defined by claim 18 further including lock means operatively connected to said armrest assemblies for locking them in fixed positions.

22. A chair as defined by claim 20 further including:

lock means engaging said gear for preventing rotation thereof.

23. A chair as defined by claim 22 wherein said lock means comprises:

a pawl slidably mounted on said first plug;

a spring biasing said pawl into engagement with said gear; and a cable actuator connected to said pawl.

* * * * *

UNITED STATES PATENT AND TRADEMARK OFFICE

CERTIFICATE OF CORRECTION

PATENT NO. : 4,951,995

DATED : August 28, 1990

INVENTOR(S) : David S. Teppo

It is certified that error appears in the above-identified patent and that said Letters Patent is hereby corrected as shown below:

Column 1, line 50;

After "incorporating" insert --the armrest--.

Column 5, line 9;

"defined" should be --define--.

Column 5, line 30;

"when" should be --wherein--.

UNITED STATES PATENT AND TRADEMARK OFFICE

CERTIFICATE OF CORRECTION

PATENT NO. : 4,951,995

DATED : August 28, 1990

INVENTOR(S) : David S. Teppo

It is certified that error appears in the above-identified patent and that said Letters Patent is hereby corrected as shown below:

Column 6, line 31;

"comprising" should be --comprises--.

Signed and Sealed this

Fifth Day of January, 1993

*Attest:*

DOUGLAS B. COMER

*Attesting Officer*

*Acting Commissioner of Patents and Trademarks*